US009933740B2

(12) United States Patent
Itagaki

(10) Patent No.: US 9,933,740 B2
(45) Date of Patent: Apr. 3, 2018

(54) IMAGE FORMING APPARATUS THAT GENERATES CONVERSION CONDITION BASED ON MEASUREMENT RESULT AND FIRST COEFFICIENT, AND WHERE CHROMATIC COLOR IMAGE IS FORMED AFTER PREDETERMINED NUMBER OF MONOCHROME IMAGES, GENERATES CONVERSION CONDITION BASED ON NEW MEASUREMENT RESULT AND SECOND COEFFICIENT

(71) Applicant: CANON KABUSHIKI KAISHA, Tokyo (JP)

(72) Inventor: Tomohisa Itagaki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/219,817

(22) Filed: Jul. 26, 2016

(65) Prior Publication Data

US 2017/0031289 A1 Feb. 2, 2017

(30) Foreign Application Priority Data

Jul. 29, 2015 (JP) ..... 2015-149972

(51) Int. Cl.
*G03G 15/00* (2006.01)

(52) U.S. Cl.
CPC . *G03G 15/5058* (2013.01); *G03G 2215/0129* (2013.01); *G03G 2215/0164* (2013.01)

(58) Field of Classification Search
CPC ..... G03G 15/5058; G03G 15/01; G03G 2215/0158
USPC ..... 399/72, 39, 43, 49
See application file for complete search history.

(56) References Cited

U.S. PATENT DOCUMENTS 5,566,372 A 10/1996 Ikeda et al.
2011/0044708 A1* 2/2011 Kusakabe ..... G03G 15/0194 399/49

FOREIGN PATENT DOCUMENTS

JP 2007298843 A * 11/2007

* cited by examiner

*Primary Examiner* — Billy Lactaoen
(74) *Attorney, Agent, or Firm* — Canon U.S.A., Inc. IP Division

(57) ABSTRACT

An image forming apparatus includes a conversion unit, an image bearing member, an image forming unit that forms an image on the image bearing member based on image data converted by the conversion unit, a measuring unit that measures a measurement image on the image bearing member, and a controller that controls the image forming unit to form a first measurement image, controls the measuring unit to measure the first measurement image, and generates a conversion condition based on a result of measurement of the first measurement image and a first feedback condition. In forming a chromatic color image after a predetermined number of monochrome images, the controller controls the image forming unit to form a second measurement image, controls the measuring unit to measure the second measurement image, and generates the conversion condition based on a result of measurement of the second measurement image and a second feedback condition.

9 Claims, 8 Drawing Sheets

FIG. 8

| | xTH | SCREEN | SIGNAL VALUE | xTH |
|---|---|---|---|---|
| 1ST SET | 1ST | 190 Dot | 20% | 1ST |
| | 2ND | | 40% | |
| | 3RD | | 60% | |
| | 4TH | | 80% | |
| | 5TH | | 100% | |
| | 6TH | 230 Dot | 20% | 1ST |
| | 7TH | | 40% | |
| | 8TH | | 60% | |
| | 9TH | | 80% | |
| | 10TH | | 100% | |
| | 11TH | COPIER | 40% | 1ST |
| 2ND SET | 12TH | 190 Dot | 20% | 2ND |
| | 13TH | | 40% | |
| | 14TH | | 60% | |
| | 15TH | | 80% | |
| | 16TH | | 100% | |
| | 17TH | 230 Dot | 20% | 2ND |
| | 18TH | | 40% | |
| | 19TH | | 60% | |
| | 20TH | | 80% | |
| | 21ST | | 100% | |
| | 22ND | COPIER | 40% | 2ND |
| 3RD SET | 23RD | 190 Dot | 20% | 3RD |
| | 24TH | | 40% | |
| | 25TH | | 60% | |
| | 26TH | | 80% | |
| | 27TH | | 100% | |
| | 28TH | 230 Dot | 20% | 3RD |
| | 29TH | | 40% | |
| | 30TH | | 60% | |
| | 31ST | | 80% | |
| | 32ND | | 100% | |
| | 33RD | COPIER | 40% | 3RD |

IMAGE FORMING APPARATUS THAT GENERATES CONVERSION CONDITION BASED ON MEASUREMENT RESULT AND FIRST COEFFICIENT, AND WHERE CHROMATIC COLOR IMAGE IS FORMED AFTER PREDETERMINED NUMBER OF MONOCHROME IMAGES, GENERATES CONVERSION CONDITION BASED ON NEW MEASUREMENT RESULT AND SECOND COEFFICIENT

BACKGROUND OF THE INVENTION

Field of the Invention

The present disclosure relates to adjusting control of the density of an image formed by an image forming apparatus.

Description of the Related Art

Electrophotographic image forming apparatuses include a charging unit that electrically charges a photosensitive member, an exposing unit that exposes the photosensitive member with a laser beam to form an electrostatic latent image on the photosensitive member, and a developing unit that develops the electrostatic latent image. The developing unit develops the electrostatic latent image with a developer to visualize the image. The image forming apparatus further includes a transfer unit and a fixing unit. The transfer unit transfers the image on the photosensitive member onto a sheet. The fixing unit fixes the image on the sheet to the sheet. Thus, an image is formed on the sheet.

To adjust the density of the image to desired density, an image forming apparatus disclosed in U.S. Pat. No. 5,566,372 forms a measurement image on an image bearing member and corrects a conversion condition for converting image data on the basis of the result of measurement of the measurement image using a measuring means. The image forming apparatus disclosed in U.S. Pat. No. 5,566,372 forms the measurement image on the image bearing member when a power switch is turned on and corrects the conversion condition on the basis of the result of measurement with the measuring means.

However, a plurality of images formed by the image forming apparatus can change in density while being continuously formed. For this reason, to reduce changes in image density while continuously forming a plurality of images, image forming apparatuses need to form a measurement image on the image bearing member at predetermined timing and to correct the conversion condition on the basis of the result of measurement of the measurement image with the measuring means.

Some image forming apparatuses form a color image after forming a monochrome image. In such a case, when the density of an image of a color different from black changes while the image forming apparatuses are continuously forming a plurality of monochrome images, the density of a color image formed after the monochrome images cannot have desired density.

SUMMARY OF THE INVENTION

The present disclosure provides an image forming apparatus including a conversion unit, an image forming unit, an image bearing member, a measuring unit, and a controller. The conversion unit converts image data based on a conversion condition. The image forming unit forms an image on the image bearing member based on image data converted by the conversion unit. The measuring unit measures a measurement image on the image bearing member. The controller controls the image forming unit to form a first measurement image, controls the measuring unit to measure the first measurement image, and generates the conversion condition based on a result of measurement of the first measurement image and a first feedback condition. In a case where a chromatic color image is formed after a predetermined number of monochrome images are formed, the controller controls the image forming unit to form a second measurement image, controls the measuring unit to measure the second measurement image, and generates the conversion condition based on a result of measurement of the second measurement image and a second feedback condition different from the first feedback condition before the chromatic color image is formed.

Further features of the present invention will become apparent from the following description of exemplary embodiments with reference to the attached drawings.

BRIEF DESCRIPTION OF THE DRAWINGS

FIG. 8 is a chart for illustrating the order of forming measurement images.

DESCRIPTION OF THE EMBODIMENTS

Configuration of Image Forming Apparatus

Figure 1:
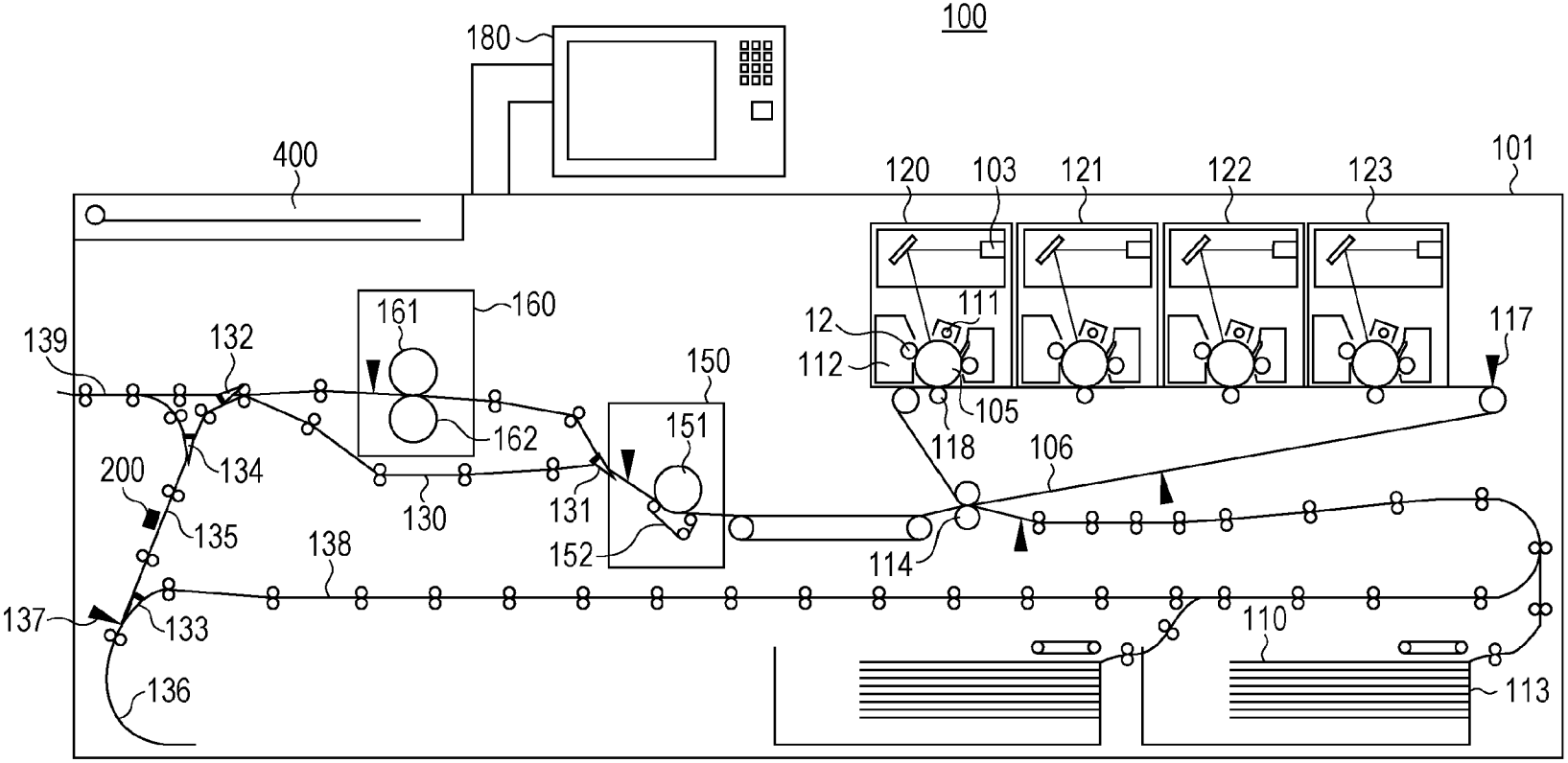
FIG. 1 is a schematic cross-sectional view of an image forming apparatus according to an embodiment of the present disclosure.

An image forming apparatus 100 according to an embodiment of the present disclosure will be described with reference to FIG. 1. The image forming apparatus 100 includes a printing unit 101, a reading unit 400, and an operating unit 180. The printing unit 101 includes four stations 120, 121, 122, and 123 for forming images corresponding to individual color components. The station 120 forms a yellow image. The station 121 forms a magenta image. The station 122 forms a cyan image. The station 123 forms a black image.

The stations 120 to 123 have the same configuration, and the configuration of the station 120 for forming a yellow image will be described hereinbelow. A photosensitive drum 105 is a photosensitive member having a photosensitive layer on its surface and is electrically charged by a charging unit 111. An electrostatic latent image is formed on the photosensitive drum 105 by scanning a laser beam emitted from an exposing unit 103 controlled on the basis of image data over the photosensitive drum 105. A developing unit 112 includes a container and a developing sleeve 12 disposed in the container. The container contains a developer containing a toner and a carrier having magnetic properties. The developing sleeve 12 is rotatably driven, with the developer born thereon. The developing unit 112 develops an electrostatic latent image with the developer to form a toner image. The photosensitive drum 105 is one example of an image bearing member that bears an image formed by the printing unit 101. The charging unit 111 and the exposing unit 103 function as a latent-image forming unit that forms an electrostatic latent image.

When a transfer voltage is applied by a power supply (not shown), a transfer roller 118 transfers the toner image on the photosensitive drum 105 to an intermediate transfer belt 106. Toner images of individual colors formed in the stations 120, 121, 122, and 123 are transferred to the intermediate transfer belt 106 one on another to cause a full-color toner image to be born on the intermediate transfer belt 106. The toner image born on the intermediate transfer belt 106 is conveyed to a transfer roller 114 by the rotation of the intermediate transfer belt 106. The intermediate transfer belt 106 is one example of an image bearing member that bears an image formed by the printing unit 101.

Sensors 117 for measuring the densities of measurement images formed on the intermediate transfer belt 106 are disposed in the periphery of the intermediate transfer belt 106. The sensors 117 are disposed at four positions in a direction perpendicular to the conveying direction of the intermediate transfer belt 106 so as to detect measurement images formed at different positions in the direction perpendicular to the conveying direction. The image forming apparatus 100 is configured to correct the densities of images formed by the stations 120, 121, 122, and 123 to desired densities on the basis of the densities of the measurement images measured by the sensors 117.

Sheets 110 in the container 113 are conveyed toward the transfer roller 114 in timing with the toner image born on the intermediate transfer belt 106. A transfer voltage is applied to the transfer roller. The transfer roller 114 transfers the toner image born on the intermediate transfer belt 106 to the sheet 110. The sheet 110 to which the toner image is transferred is conveyed to a fixing unit 150 and a fixing unit 160.

The fixing units 150 and 160 fix the toner image transferred to the sheet 110 to the sheet 110 by heating and pressing the toner image. The fixing unit 150 includes a fixing roller 151 including a heater for heating the sheet 110 and a pressure belt 152 that brings the sheet 110 into pressure-contact with the fixing roller 151. The fixing unit 160 is disposed downstream from the fixing unit 150 in the sheet 110 conveying direction. The fixing unit 160 glosses the toner image on the sheet 110 that has passed through the fixing unit 150. The fixing unit 160 includes a fixing roller 161 including a heater for heating the sheet 110 and a pressure roller 162.

In fixing an image to the sheet 110 in a glossing mode or fixing an image to a sheet 110 that needs a large amount of heat for fixing, such as cardboard, the sheet 110 that has passed through the fixing unit 150 is conveyed to the fixing unit 160. In fixing an image to a sheet 110, such as plain paper or thin paper, the sheet 110 that has passed through the fixing unit 150 is conveyed along a conveying path 130 that bypaths the fixing unit 160. To control the conveying path of the sheet 110 toward the fixing unit 160 or to the bypath of the fixing unit 160, the angle of a flapper 131 is adjusted.

A flapper 132 is a guide member for switching the sheet 110 between a conveying path 135 and a conveying path 139 to the outside. The sheet 110 conveyed along the conveying path 135 is conveyed to a reversing unit 136. When a reverse sensor 137 disposed in the conveying path 135 detects the trailing end of the sheet 110, the conveying direction of the sheet 110 is reversed.

A flapper 133 is a guide member for switching the sheet 110 between a conveying path 138 for double-sided printing and the conveying path 135. When a face-down sheet discharge mode is executed, the sheet 110 is again conveyed to the conveying path 135 and is discharged from the image forming apparatus 100.

If a double-sided printing mode is executed, the sheet 110 is again conveyed toward the transfer roller 114 along the conveying path 138. In the double-sided printing mode, an image is fixed on a first surface of the sheet 110, then the sheet 110 is switched back in the reversing unit 136 toward the transfer roller 114 along the conveying path 138, and an image is formed on a second surface of the sheet 110.

A flapper 134 is a guide member for guiding the sheet 110 toward the conveying path 139 for discharging the sheet 110 from the image forming apparatus 100. In discharging the sheet 110, with the face down, the flapper 134 guides the sheet 110 switched back by the reversing unit 136 toward the discharge conveying path 139. The sheet 110 conveyed along the discharge conveying path 139 is discharged out of the image forming apparatus 100.

The conveying path 135 is provided with density sensors 200 for measuring the densities of the measurement images on the sheet 110. The density sensors 200 are disposed at four positions in the direction perpendicular to the conveying direction of the sheet 110 so as to detect of four rows of measurement images.

An operating unit 180 includes a liquid crystal display serving as a display and a key input unit. The operating unit 180 is an interface for the user to use in inputting the number of prints of the image and a print mode. The user can select a one-sided printing mode or a double-sided printing mode, execute a face-down discharge mode, and select a monochrome mode or a color mode using the operating unit 180.

Figure 3:
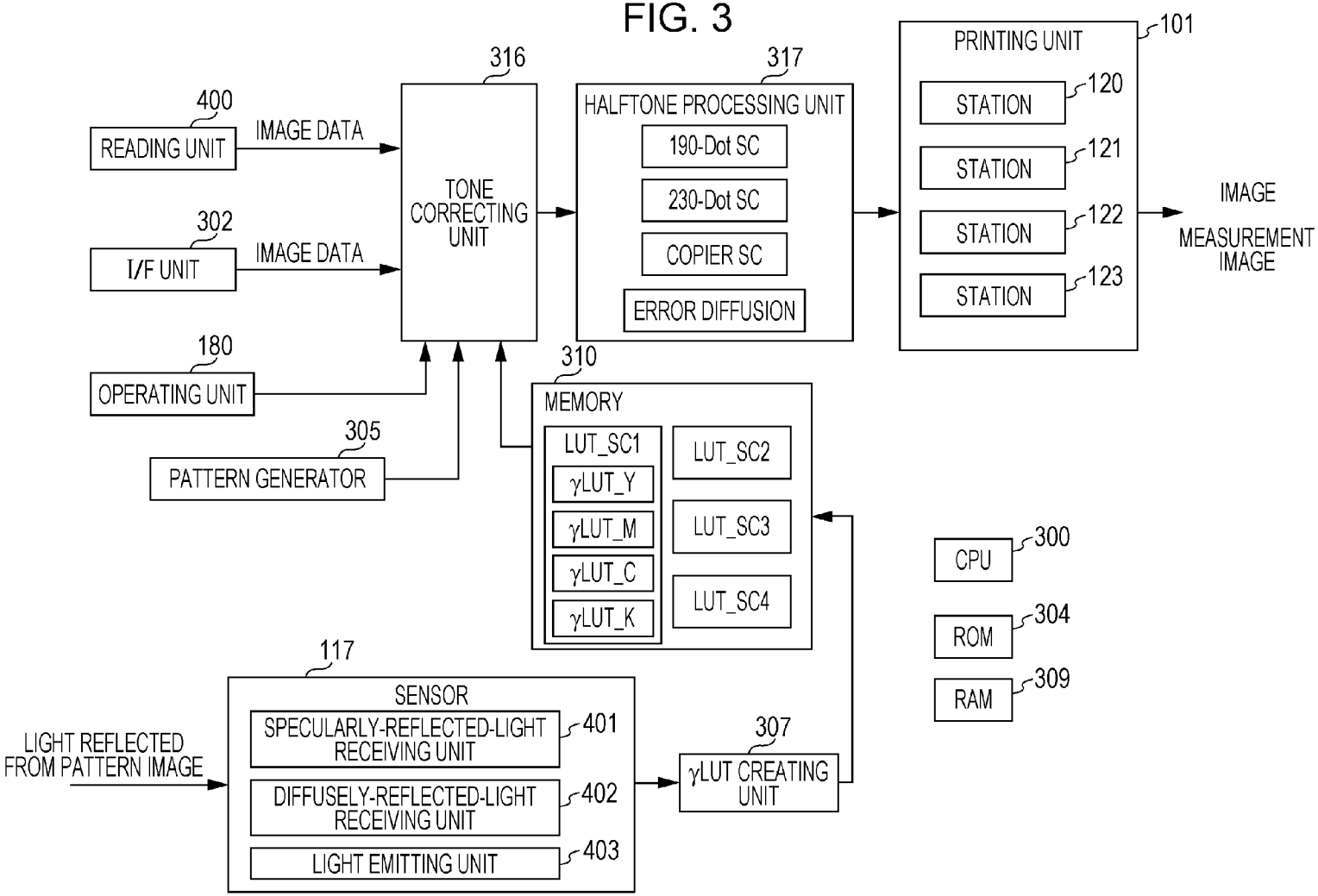
FIG. 3 is a control block diagram of the image forming apparatus.

A reading unit 400 includes a unit including a light source, an optical system, and a CCD sensor and a platen. The reading unit 400 reads an image of an original placed on the platen. When an original is placed on the platen, and a reading start button of the operating unit 180 is pressed by the user, the reading unit 400 executes a reading operation. When the reading operation is executed, light emitted from the light source is reflected by the original placed on the platen. The light reflected from the original forms an image on the CCD sensor via the optical system including a lens. When the light reflected from the original forms an image on the CCD sensor, luminance data indicating the result of reading the original is acquired. The reading unit 400 converts the luminance data to density data (image data) using a luminance-to-density conversion table and transfers the density data to a tone correction unit 316 (FIG. 3) of the image forming apparatus 100. The luminance-to-density conversion table is stored in advance in a ROM 304 (FIG. 3).

Configuration of Sensors

Figure 2:
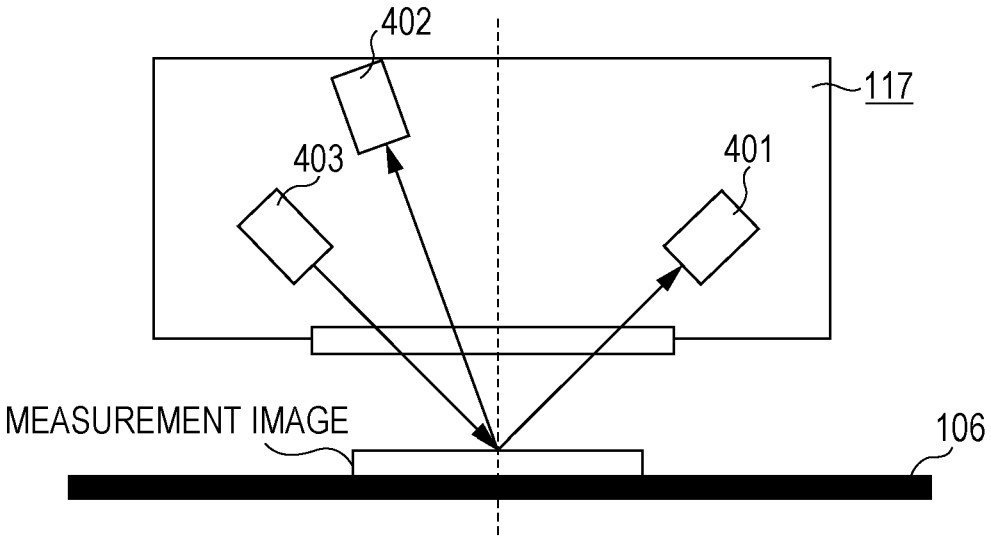
FIG. 2 is a cross-sectional view of the main components of a sensor.

The configuration of the sensors 117 disposed in the image forming apparatus 100 will be described with reference to FIG. 2. Each sensor 117 includes a specularly-reflected-light receiving unit 401, a diffusely-reflected-light receiving unit 402, and a light emitting unit 403. The sensor 117 may further include an optical element, such as a lens.

The light emitting unit 403 is a light emitting device that emits light to a measurement image formed on the intermediate transfer belt 106. The wavelength of light emitted from the light emitting unit 403 is set to, for example, 800 to 850 nm in consideration of the spectral reflectivity of the toner. The light from the light emitting unit 403 is emitted at an angle of 45 degrees with respect to a direction perpendicular to the surface of the intermediate transfer belt 106.

The specularly-reflected-light receiving unit 401 is disposed on an imaginary line at an angle of 45 degrees with respect to the direction perpendicular to the surface of the intermediate transfer belt 106. For example, the light emitting unit 403 and the specularly-reflected-light receiving unit 401 are disposed at opposed positions about a plane perpendicular to the surface of the intermediate transfer belt 106. The specularly-reflected-light receiving unit 401 receives light specularly reflected from the measurement image formed on the intermediate transfer belt 106. The specularly-reflected-light receiving unit 401 outputs a sensor output value (a voltage value) according to the intensity of the reflected light from the measurement image.

The diffusely-reflected-light receiving unit 402 is disposed at a position that does not receive the specularly reflected light from the intermediate transfer belt 106. The diffusely-reflected-light receiving unit 402 is disposed on an imaginary line at an angle of, for example, 20 degrees, with respect to the direction perpendicular to the surface of the intermediate transfer belt 106. The diffusely-reflected-light receiving unit 402 receives diffusely reflected light from the measurement image on the intermediate transfer belt 106. The diffusely-reflected-light receiving unit 402 outputs a sensor output value (a voltage value) according to the intensity of the reflected light from the measurement image.

The image forming apparatus 100 measures the density of the measurement image on the basis of the sensor output value of the specularly-reflected-light receiving unit 401 and the sensor output value of the diffusely-reflected-light receiving unit 402. For example, the image forming apparatus 100 determines the intensity of the measurement image by calculation using the sensor output value of the specularly-reflected-light receiving unit 401 and the sensor output value of the diffusely-reflected-light receiving unit 402. Alternatively, the image forming apparatus 100 determines the intensity of the measurement image with reference to a table indicating the correspondence relationship between densities and a combination of the sensor output value of the specularly-reflected-light receiving unit 401 and the sensor output value of the diffusely-reflected-light receiving unit 402.

Configuration of Controller

FIG. 3 is a control block diagram of the image forming apparatus 100. A CPU 300 is a control circuit that controls the components of the image forming apparatus 100. The ROM 304 stores control programs necessary for executing the various processes of a flowchart executed by the CPU 300, described later. A RAM 309 is a system work memory for operating the CPU 300.

The printing unit 101 corresponds to the stations 120, 121, 122, and 123, the transfer roller 118, the intermediate transfer belt 106, the transfer roller 114, the fixing unit 150, and the fixing unit 160. Descriptions of the operating unit 180 and the reading unit 400 will be omitted here because they have already been described. An I/F unit 302 is an interface to which image data transferred from an external PC is input.

A tone correction unit 316 converts input image data by performing various image processes on the image data. An image formed by the printing unit 101 does not have a desired density. For this reason, the tone correction unit 316 corrects the input value (image signal value) of the image data so that the image formed by the printing unit 101 has a desired density. The tone correction unit 316 converts the image data on the basis of a tone correction table (γLUT) stored in a memory 310. The memory 310 stores the tone correction table for each screen, described later, and for each color. The tone correction table (γLUT) corresponds to a conversion condition for converting image data. The tone correction unit 316 may be implemented by an integrated circuit, such as an application specific integrated circuit (ASIC), or may be implemented by converting the image data with the CPU 300 on the basis of a program stored in advance.

A halftone processing unit 317 applies screening suitable for the kind of the image on image data converted by the tone correction unit 316. The halftone processing unit 317 converts image data so that a photographic image or a graphic image has good tone by using, for example, a 190-dot screen. The halftone processing unit 317 converts image data so that a character image is clearly printed by using, for example, a 230-dot screen. The halftone processing unit 317 converts image data so that a high-resolution image has little moiré by using, for example, an error diffusion method.

When input image data is image data for print created in a page description language, the halftone processing unit 317 converts the image data using the 190-Dot screen, the 230-Dot screen, and the error diffusion method. When an image other than a character image of an original that the reading unit 400 read is to be printed, the halftone processing unit 317 converts the image data transferred from the reading unit 400 using a copier screen.

Figure 4A:
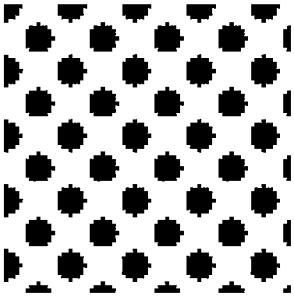
FIG. 4A is an enlarged view of an image processed using the 190-dot screen.
Figure 4B:
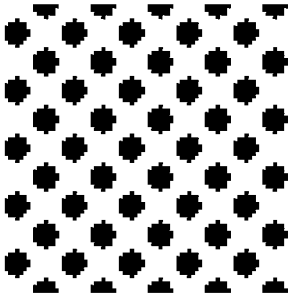
FIG. 4B is an enlarged view of an image processed using a 230-dot screen.
Figure 4C:
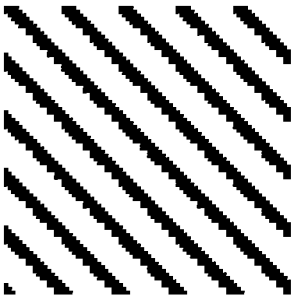
FIG. 4C is an enlarged view of an image processed using a copier screen.
Figure 4D:
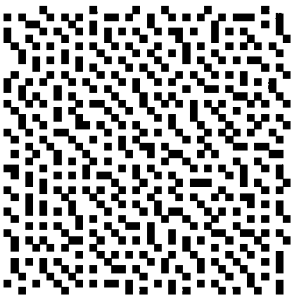
FIG. 4D is an enlarged view of an image processed using an error diffusion method.

FIG. 4A is an enlarged view of an image (halftone) processed using the 190-dot screen. FIG. 4B is an enlarged view of an image (halftone) processed using the 230-dot screen. FIG. 4C is an enlarged view of an image (halftone) processed using the copier screen. FIG. 4D is an enlarged view of an image (halftone) processed using the error diffusion method. The above screens are mere examples and are not intended to limit the present disclosure.

A tone correction table LUT_SC1 stored in the memory 310 is a conversion condition for converting image data on graphic images. A tone correction table LUT_SC2 is a conversion condition for converting image data on character images. A tone correction table LUT_SC3 is a conversion condition for converting image data input from the reading unit 400. A tone correction table LUT_SC4 is a conversion condition for converting image data on photographic images.

The image data subjected to screening by the halftone processing unit 317 is input to the printing unit 101. The printing unit 101 forms an image based on the input image data on the sheet 110.

A pattern generator 305 outputs measurement image data. The printing unit 101 forms a measurement image in a region between an image born on the intermediate transfer belt 106 and an image next to the image on the basis of the measurement image data output from the pattern generator 305. The CPU 300 acquires a sensor output value at the timing when the measurement image on the intermediate transfer belt 106 passes through the measurement position of the sensor 117 and determines the intensity of the measurement image with reference to the above-described luminance-to-density conversion table.

A γLUT creating unit 307 creates a tone correction table (γLUT) on the basis of the intensity of the measurement image measured with the CPU 300 and the sensor 117 and a predetermined desired density. The measurement image is formed for each color and for each screen. The γLUT creating unit 307 creates tone correction tables corresponding to the individual measurement images on the basis of the results of measurement of the measurement images.

Density Adjusting Control

Next, density adjusting control will be described. The image forming apparatus 100 is capable of three kinds of density adjusting control: an automatic tone correction and tone corrections A and B.

The automatic tone correction is control for forming pattern images on the sheet 110 with the printing unit 101 and creating tone correction tables on the basis of the densities of the pattern images measured by the density sensors 200 or the reading unit 400. The pattern images are formed on the sheet 110 by the number corresponding to 22 tone levels for each screen and each color. The pattern images are formed on the sheet 110 by the number corresponding to four colors and four screens.

The automatic tone correction consumes many sheets 110 because it requires forming pattern images on the sheets 110. For this reason, tone corrections A and B for correcting the tone correction tables without consuming many sheets 110 are performed.

The tone correction A is density adjusting control for updating the tone correction tables without decreasing productivity. The tone correction A frequently updates the tone correction tables during an image forming operation.

The tone correction A is control for forming measurement images PA between adjacent images on the intermediate transfer belt 106 with the printing unit 101 while a plurality of images are being formed and creating tone correction tables on the basis of the result of measurement of the measurement images PA with the sensor 117. The measurement images PA include a measurement image processed using the 190-dot screen, a measurement image processed using the 230-dot screen, and a measurement image processed using the copier screen.

The measurement images PA are formed by the number of five tone levels for each screen. Each measurement image PA is formed for only one tone level between adjacent images. This is for the purpose of enhancing the productivity of the image forming apparatus 100. For this reason, the tone correction tables are not updated until the results of measurement for five tone levels are acquired.

The tone correction B allows the densities of images to be more accurately corrected to desired densities than the tone correction A does, although the tone correction B decreases the productivity as compared with the tone correction A. The tone correction B forms measurement images PB with more toner levels than that of the measurement images PA formed by the tone correction A to correct the tone correction tables.

The tone correction B is control for forming measurement images PB on the intermediate transfer belt 106 with the printing unit 101 and creating tone correction tables on the basis of the result of measurement of the measurement images PB with the sensors 117. The measurement images PB also include a measurement image processed using the 190-dot screen, a measurement image processed using the 230-dot screen, and a measurement image processed using the copier screen, as the measurement images PA do.

The measurement images PB are formed by the number of ten tone levels for each screen. Each measurement images PB are formed between adjacent images by the number corresponding to three screens and ten tone levels.

Table shows image signal values and the feedback percentages (FB percentages) of the measurement images PA and PB. The feedback percentage corresponds to a feedback coefficient. Image signal values of measurement image data for forming the measurement images PA are 20%, 40%, 60%, 80%, and 100% (the highest density). Image signal values of measurement image data for forming the measurement images PB are 10%, 20%, 30%, 40%, 50%, 60%, 70%, 80%, 90%, and 100% (the highest density).

TABLE

| Signal value | Measurement image PA | Measurement image PB |
|---|---|---|
| 10% | Non printing | Printing |
| 20% | Printing | Printing |
| 30% | Non printing | Printing |
| 40% | Printing | Printing |
| 50% | Non printing | Printing |
| 60% | Printing | Printing |
| 70% | Non printing | Printing |
| 80% | Printing | Printing |
| 90% | Non printing | Printing |
| 100% | Printing | Printing |
| | FB percentage: 40% | FB percentage: 100% |

The measurement images PA and the measurement images PB differ not only in the tone levels but also the feedback percentage. The feedback percentage is the percentage of correction to the difference ΔD between the intensity of a measurement image and a desired density. If a difference between the density of the measurement image and the desired density is a predetermined value, the difference between tone characteristics corrected on the basis of a tone correction table created using a feedback percentage of 100% and reference tone characteristics is smaller than the difference between tone characteristics corrected on the basis of a tone correction table created using a feedback percentage of 30% and a reference tone characteristic. In the tone correction A, tone correction tables are created to correct 40% of the difference ΔD between the intensity of the measurement image and the desired density. In the tone correction B, tone correction tables are created so that the intensity of the measurement image reaches the desired density.

In the tone correction A, the feedback percentage is set to 40% to reduce the difference in density between an image on the first page and an image on the (X+1)th page. In the tone correction B, the feedback percentage is set to 100%. This is because the image forming apparatus 100 executes the tone correction B when there is a high probability that an image formed by the printing unit 101 suddenly changes in density. For example, the tone correction B is executed when a power source is turned on or when a color image is to be printed after a large amount of monochrome images are printed. In other words, the tone correction B is executed under a situation in which images to be printed have no continuity.

Next, the measurement images PA and PB that are respectively formed on the intermediate transfer belt 106 by the tone correction A and B will be described with reference to FIGS. 5A to 5C.

Figure 5A:
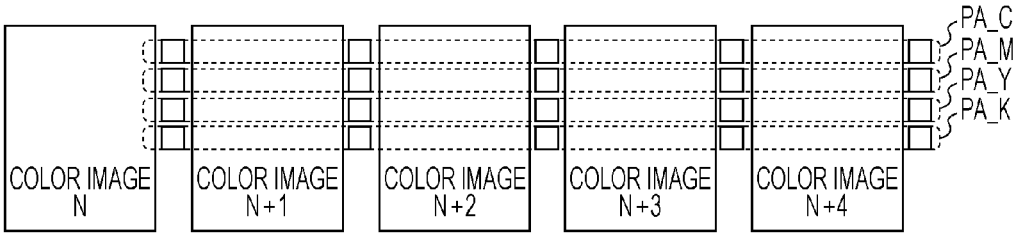
FIG. 5A is a schematic diagram of color measurement images.

FIG. 5A is a schematic diagram illustrating the state of color measurement images PA_C, PA_M, PA_Y, and PA_K formed on the intermediate transfer belt 106 while a color mode is executed to form color images. The measurement images PA_C are cyan measurement images, the measurement images PA_M are magenta measurement images, the measurement images PA_Y are yellow measurement images, and the measurement images PA_K are black measurement images.

Figure 5B:
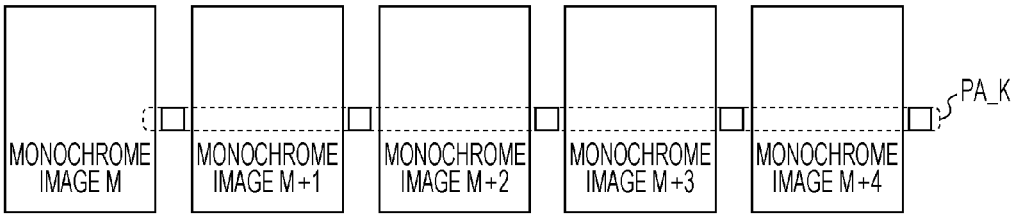
FIG. 5B is a schematic diagram of black measurement images.
Figure 5C:
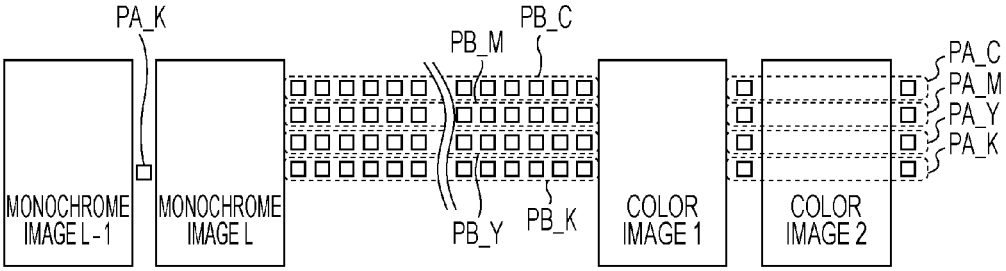
FIG. 5C is a schematic diagram of color measurement images and black measurement images.

FIG. 5B is a schematic diagram illustrating the state of black measurement images PA_K formed on the intermediate transfer belt 106 while a monochrome mode is executed to form monochrome images. While the monochrome mode is executed, the measurement images PA_C, PA_M, and PA_Y are not formed on the intermediate transfer belt 106.

When the monochrome mode is executed, the intermediate transfer belt 106 and the stations 120, 121, and 122 of the image forming apparatus 100 are not separated so as to reduce downtime even if a color image is formed after a few monochrome images are formed. Furthermore, while the monochrome mode is executed, the rotary drive of the developing sleeves 12 for yellow, magenta, and cyan is stopped to prevent yellow, magenta, and cyan developers in the developing unit 112 from being degraded. In other words, the developing sleeves 12 for yellow, magenta, and cyan function as second rotational bodies, and the developing sleeve 12 for black functions as a first rotational body.

Therefore, in the monochrome mode, cyan, magenta, and yellow measurement images are not formed, and tone correction tables for cyan, magenta, and yellow are not updated. Since the developing sleeves 12 for cyan, magenta, and yellow are not rotationally driven, the amounts of charged toner in the developing units 112 for cyan, magenta, and yellow decreases. When the amounts of charged toner change, the densities of the images also change. Therefore, in the case where, after a plurality of monochrome images are continuously formed in the monochrome mode, a color image is formed in the color mode, the density of the color image is very likely to change.

For this reason, when the image forming apparatus 100 executes a full color mode after the monochrome mode is executed in which a predetermined number or more of pages of monochrome images are continuously formed, the tone correction B is executed before a full-color image is formed. The predetermined number of pages is, for example, 1,000 pages. FIG. 5C is a schematic diagram illustrating the state of measurement images PB formed on the intermediate transfer belt 106 before color images are formed in the color mode after 1,000 or more pages of monochrome images are formed in the monochrome mode.

When color images are formed after a large amount of monochrome images are formed, the amounts of charged toner in the developing units 112 for yellow, magenta, and cyan can be decreased, so that the densities of the color images cannot be controlled to desired densities. In forming color images after forming a large amount of monochrome images, the tone correction B is executed before the color images are formed, and tone correction tables suitable for the amounts of charged toner in the developing units 112 for yellow, magenta, and cyan are created. This prevents changes in the density of the color images even if color images are formed after a large amount of monochrome images are formed.

Image Forming Process

The tone corrections A and B that the CPU 300 of the image forming apparatus 100 executes will be described with reference to the flowchart in FIG. 6. When image data for copying corresponding to an original is input from the reading unit 400 or when image data for printing transferred via the I/F unit 302 is input, the CPU 300 starts an image forming operation.

First, the CPU 300 determines whether a monochrome mode for forming a monochrome image is selected (S100). If at step S100 the monochrome mode is selected with the operating unit 180, the CPU 300 goes to step S101. Alternatively, when a signal instructing to form an image in the monochrome mode is input via the I/F unit 302, the CPU 300 goes to step S101.

If the monochrome mode is selected, the CPU 300 executes the tone correction A. The CPU 300 determines a screen for the measurement images PA and an image signal value (S101). Next, the CPU 300 forms an image on the basis of the image data by controlling the printing unit 101 (S102) and forms measurement images PA in the above-described region on the intermediate transfer belt 106 (S103). In the monochrome mode, only the black measurement images PA_K are formed on the intermediate transfer belt 106.

In the tone correction A, only one measurement image PA is formed for each color every time one page of an image is formed. For this reason, at step S101, the CPU 300 selects one from image signal values (20%, 40%, 60%, 80%, and 100%) for forming the measurement images PA shown in Table. Furthermore, at step S101, the CPU 300 selects a screen for the measurement images PA from the 190-dot screen, the 230-dot screen, and the copier screen.

At step S103, the CPU 300 causes the pattern generator 305 to output measurement image data with the selected image signal value and causes the tone correction unit 316 to correct the measurement image data on the basis of a tone correction table corresponding to the selected screen. Next, the CPU 300 causes the halftone processing unit 317 to convert the image data using the selected screen and controls the printing unit 101 to form measurement images PA on the intermediate transfer belt 106.

Then, the CPU 300 measures the densities of the measurement images PA with the sensors 117 (S104) and determines whether a necessary number of measurement data items for updating the tone correction table are completed (S105). If at step S105 a predetermined number of measurement data items for each screen are not completed, the CPU 300 prepares for forming an image of one page without correcting the tone correction table. The densities of the measurement images PA (measurement data) are stored in the RAM 309.

In contrast, if at step S105 a necessary number of measurement data items are completed, the CPU 300 creates a tone correction table on the basis of the measurement data (S106) and prepares for forming an image of the next page. At step S106, the γLUT creating unit 307 creates tone correction tables corresponding to the screens and colors of the measurement images PA on the basis of the densities of the measurement images PA and their desired densities. When the monochrome mode is executed, only the black measurement images PA are formed, a tone correction table corresponding to the black images is created.

Figure 7:
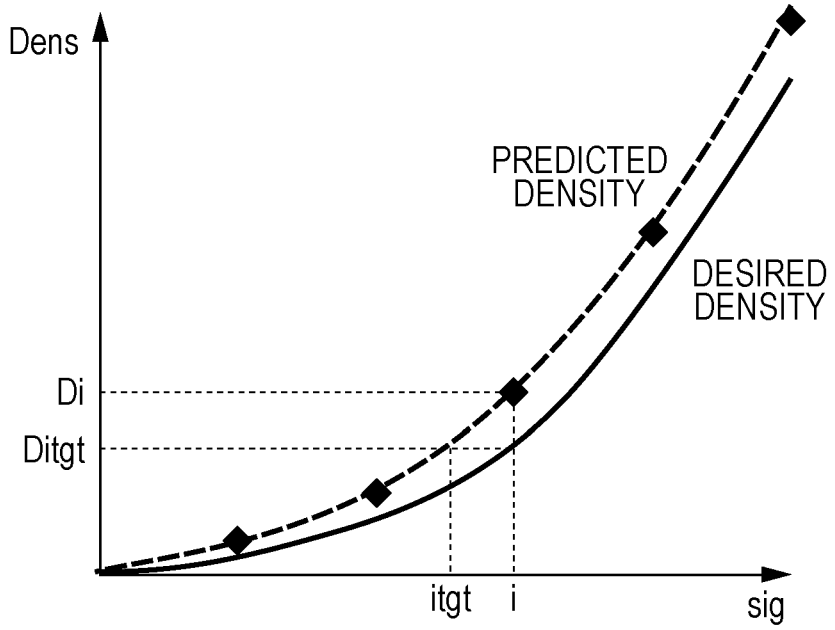
FIG. 7 is a graph for illustrating a method for correcting the tone characteristics of the image forming apparatus.

FIG. 7 is a graph for illustrating the concept of the tone correction table created by the γLUT creating unit 307. The horizontal axis indicates image signal values, and the vertical axis indicates densities. The solid line indicates an ideal tone characteristic showing the correspondence relationship between image signals and desired densities. The broken line indicates the tone characteristic of the printing unit 101 calculated by linear interpolation from the densities of the measurement images PA measured by the sensors 117. To convert the density Di of an image signal value i to a desired density Ditgt, the image signal value i is converted to an image signal value itgt corresponding to the desired density Ditgt of the image signal value i. The γLUT creating unit 307 creates a table for converting the image signal value i to the image signal value itgt as a tone correction table.

Figure 6:
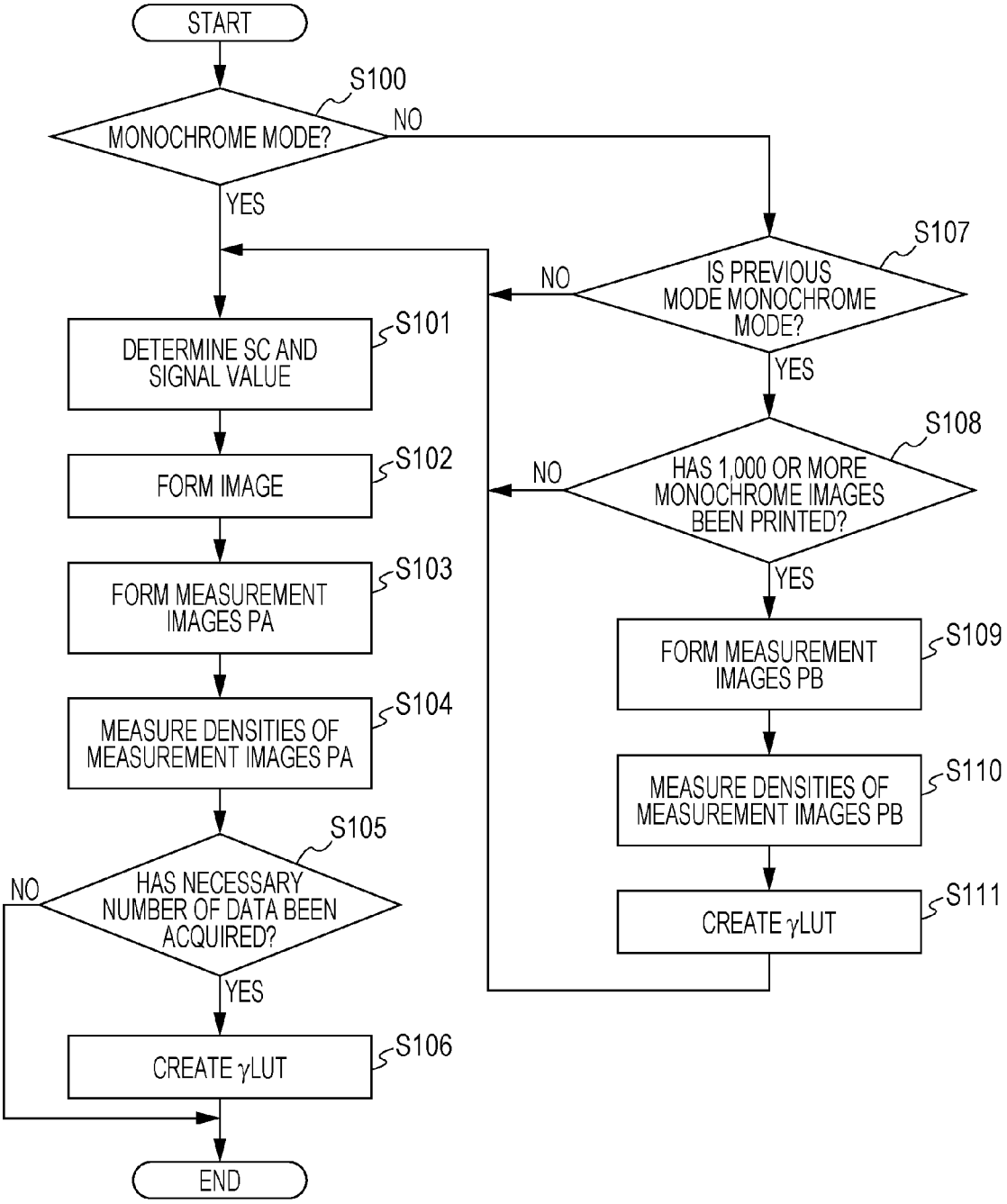
FIG. 6 is a flowchart for tone correction.

Referring back to the flowchart in FIG. 6, if at step S100 the monochrome mode is not selected, the CPU 300 determines whether the previous image forming mode is the monochrome mode to determine whether it is at the timing to execute the tone correction B (S107).

If at step S107 it is determined that the previous image forming mode is not the monochrome mode, then the CPU 300 determines that it is not the timing to execute the tone correction B. The CPU 300 determines screens for the measurement images PA and mage signal values to execute the tone correction A (S101). Then the CPU 300 forms an image on the basis of the current image forming mode (S102) and forms the measurement images PA on the intermediate transfer belt 106 (S103). The measurement images PA formed in the color mode correspond to four colors. Therefore, at step S101, the CPU 300 selects screens and image signal values for the individual colors. Processes of step S104 and the subsequent steps are the same as those of the above, and their detailed descriptions will be omitted. If a color mode is executed, measurement images PA for cyan, magenta, yellow, and black are formed, and, at S106, tone correction tables corresponding to cyan, magenta, yellow, and black images are created.

If at step S107 it is determined that the previous image forming mode is the monochrome mode, the CPU 300 determines whether 1,000 or more pages of monochrome images are continuously formed to determine whether it is the timing to execute the tone correction B (S108). The CPU 300 includes a counter that counts, for example, the number of monochrome images formed. The CPU 300 increases the value of the counter by one every time one page of a monochrome image is formed. If a color image is formed after monochrome images are formed, the CPU 300 sets the value of the counter to 0. This allows the CPU 300 to determine whether 1,000 or more pages of monochrome images are continuously formed on the basis of the value of the counter.

If at step S108 it is determined that 1,000 or more pages of monochrome images are not continuously formed, the CPU 300 determines that it is not the timing to execute the tone correction B. The CPU 300 goes to step S101 to execute the tone correction A.

In contrast, if at step S108 it is determined that 1,000 or more pages of monochrome images are continuously formed, the CPU 300 determines to execute the tone correction B. The CPU 300 rotates the developing sleeves 12 for a predetermined time before forming a color image and controls the printing unit 101 to form the measurement images PB on the intermediate transfer belt 106 (S109).

In the tone correction B, the measurement images PB are formed for ten tone levels for each color using all screens: the 190-dot screen, the 230-dot screen, and the copier screen. The CPU 300 selects all of the image signal values (10%, 20%, 30%, 40%, 50%, 60%, 70%, 80%, 90%, and 100%) shown in Table as image signal values for forming the measurement images PB. Furthermore, the CPU 300 selects the 190-dot screen, the 230-dot screen, and the copier screen as screens for the measurement images PB.

At step S109, the CPU 300 causes the pattern generator 305 to output measurement image data with the selected image signal values in sequence and causes the tone correction unit 316 to correct the measurement image data on the basis of tone correction tables corresponding to the selected screens. Next, the CPU 300 causes the halftone processing unit 317 to convert the measurement image data using the selected screens and controls the printing unit 101 to form measurement images PB on the intermediate transfer belt 106.

Next, the CPU 300 measures the densities of the measurement images PB with the sensors 117 (S110), creates tone correction tables on the basis of measurement data corresponding to ten tone levels (S111), and goes to step S101 to form color images. At step S111, the γLUT creating unit 307 creates tone correction tables corresponding to the screens and colors of the measurement images PB on the basis of the densities of the measurement images PB corresponding to ten tone levels and their desired density.

When forming a color image after forming a plurality of monochrome images by a threshold or more, the image forming apparatus 100 executes the tone correction B to update the tone correction tables for the individual colors before forming the color image. This prevents a change in the density of the color image. Furthermore, the image forming apparatus 100 rotationally drives the developing sleeves 12 for a predetermined time before forming the measurement images PB. This increases the amounts of charged developers (toner) decreased while the monochrome images are formed. If the amounts of charged developers (toner) are low, the amount can suddenly increase during the image forming operation. Thus, the color image forming operation is started, with the amounts of charged developers (toner) increased. This prevents a sudden change in the amounts of charged developers (toner) during an image forming operation. Thus, executing the tone correction A during an image forming operation prevents a sudden change in the density of images.

Order of Forming Measurement Images PA

In the tone correction A, since the tone correction tables are not updated until measurement data for five tone levels is completed, a sudden change in density cannot be accurately reduced. For this reason, the order of precedence of the screens for the measurement images PA is determined in advance so that a change in the density of a graphic image whose color is to be stabilized can be accurately reduced.

Descriptions of the screens, the error diffusion method, and the uses are as follows:

190-dot screen: for use in printing photographic images and graphic images. Frequently used, for example, for people photographs that require accurate color reproduction.

230-dot screen: for use in printing character images; having lines more than that of the 190-dot screen, so that jaggies of halftone characters are inconspicuous; and the density of character images is designated by the user in many cases.

Copier screen: for use in printing images other than character images of copy images; having a lower tone level, resolution, and granularity than those of print images.

Error diffusion method: for use in a map mode, in printing character images of a copy image, and in printing images for printing when designated by the user; suitable for printing high-resolution images; and preventing moiré in images.

The image forming apparatus 100 forms measurement images PA corresponding to the 190-dot screen and the 230-dot screen for preventing a change in color by the number of five tone levels for each screen. This allows the tone characteristics of graphic images and photographic images to be accurately corrected over a wide range. The image forming apparatus 100 forms measurement images PA corresponding to the copier screen by the number corresponding to one tone level.

Since the measurement images PA corresponding to the copier screen are formed by the number corresponding to only one tone level, the γLUT creating unit 307 calculates tone characteristics from the densities of the measurement images PA with one tone level and creates a tone correction table for the copier screen. Since the numbers of tone levels of the measurement images PA corresponding to the 190-dot screen and the 230-dot screen for use in print images are larger than the number of tone levels of measurement images PA corresponding to the copier screen, the tone characteristics of print images can be accurately corrected as compared with copy images.

FIG. 8 is a chart showing screens for measurement images PA formed in the tone correction A and image signal values. While 12 pages of images are being formed, a total of 11 measurement images: five measurement images corresponding to the 190-dot screen, five measurement images corresponding to the 230-dot screen, and one measurement image corresponding to the copier screen, are formed. The image forming apparatus 100 repeatedly forms 11 measurement images PA. The image forming apparatus 100 updates tone correction tables corresponding to the individual screens every time 12 pages of images are formed.

The copier screen for use in forming a copy image is smaller in the number of tone levels than the 190-dot screen and the 230-dot screen for use in forming print images. This allows the tone correction tables for use in forming print images to be accurately corrected in a wide range from low density to high density. Furthermore, since the tone correction tables for use in forming a print image can be frequently updated, the density of the print image can be stabilized even if the density of the image suddenly changes.

Although in the above configuration the tone correction B is executed when a color image is formed after 1,000 pages or more of monochrome images are continuously formed, the tone correction B may be executed when the density of the color image is predicted to change.

The above configuration is such that the developing sleeves 12 for yellow, magenta, and cyan are not rotationally driven in the monochrome mode, while the amount of charged toner changes also when the developing sleeves 12 are rotationally driven. For this reason, when the number of monochrome images continuously formed is larger than a threshold in a configuration in which the developing sleeves 12 for yellow, magenta, and cyan are rotationally driven in the monochrome mode, the tone correction B may be executed before a color image is formed.

The above configuration includes four sensors 117 at positions for measuring measurement images formed on the intermediate transfer belt 106, while the sensors 117 may be disposed at positions for measuring measurement images formed on the individual photosensitive drums 105. For example, if the intermediate transfer belt 106 is black, so that the accuracy of measurement of a black measurement image is low, the black measurement image may be measured with a sensor 117 disposed on the black photosensitive drum 105. The black measurement image is measured with the sensor 117 disposed on the black photosensitive drum 105, while cyan, magenta, and yellow measurement images are measured with the sensors 117 disposed on the intermediate transfer belt 106. The sensor 117 disposed on the black photosensitive drum 105 functions as a first measuring unit for measuring a first measurement image on a first photosensitive member, and the sensors 117 disposed on the intermediate transfer belt 106 function as second measuring units for measuring second measurement images on an image bearing member.

In the above configuration, a feedback percentage corresponding to measurement images PA formed in the monochrome mode and a feedback percentage corresponding to measurement images PA formed in the color mode are set to the same value. Alternatively, the feedback percentage corresponding to the measurement images PA formed in the monochrome mode and the feedback percentage corresponding to the measurement images PA formed in the color mode may be set to different values.

It is only required that the feedback percentage corresponding to the measurement images PA formed in the monochrome mode and the feedback percentage corresponding to the measurement images PA formed in the color mode are lower than a feedback percentage corresponding to the measurement images PB.

Some embodiments of the present disclosure accurately prevent a change in the density of a color image formed after a plurality of monochrome images are continuously formed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-149972, filed Jul. 29, 2015, which is hereby incorporated by reference herein in its entirety.

What is claimed is:

1. An image forming apparatus comprising:

a conversion unit configured to convert image data based on a conversion condition;

an image bearing member;

an image forming unit configured to form an image on the image bearing member based on the converted image data;

a measuring unit configured to measure a measurement image on the image bearing member; and a controller configured to control the image forming unit to form a first measurement image, to control the measuring unit to measure the first measurement image, and to generate the conversion condition based on a result of measurement of the first measurement image and a first coefficient, wherein in a case where a chromatic color image is formed after a predetermined number of monochrome images are formed, the controller controls the image forming unit to form a second measurement image, controls the measuring unit to measure the second measurement image, and generates the conversion condition based on a result of measurement of the second measurement image and a second coefficient different from the first coefficient before the chromatic color image is formed, wherein the image forming unit comprises a first image forming unit that forms an image with a black developer and a second image forming unit that forms an image with a developer of a different color different from the black, and wherein the conversion condition comprises a first conversion condition for correcting a tone characteristic of the image formed by the first image forming unit and a second conversion condition for correcting a tone characteristic of the image formed by the second image forming unit.

2. The image forming apparatus according to claim 1, wherein an absolute value of the second coefficient is larger than an absolute value of the first coefficient.

3. The image forming apparatus according to claim 1,
wherein the controller generates a first conversion condition based on a predetermined result and the first coefficient,
wherein the controller generates a second conversion condition based on the predetermined result the second coefficient, and
wherein a difference between a tone characteristic of an image formed by the image forming unit based on the second conversion condition and a reference tone characteristic is smaller than a difference between a tone characteristic of an image formed by the image forming unit based on the first conversion condition and the reference tone characteristic.

4. The image forming apparatus according to claim 1,
wherein the first image forming unit comprises a first developer bearing member that bears the black developer,
wherein the second image forming unit comprises a second developer bearing member that bears the developer of the different color, and
wherein, when the chromatic color image is to be formed after the predetermined number or more of the monochrome images are formed, the controller controls the second developer bearing member to be rotationally driven for a predetermined time, controls the first image forming unit and the second image forming unit to form the second measurement image, controls the measuring unit to measure the second measurement image, and before the chromatic color image is formed, generates the first conversion condition and the second conversion condition based on a result of measurement of the second measurement image and the second coefficient.

5. The image forming apparatus according to claim 1, wherein, when the image forming unit continuously forms the monochrome image, the controller controls the first image forming unit to form the first measurement image, controls the measuring unit to measure the first measurement image, and generates the first conversion condition based on a result of measurement of the first measurement image and the first coefficient.

6. The image forming apparatus according to claim 5, wherein the controller disables the second image forming unit from forming the first measurement image in a state in which the image forming unit continuously forms the monochrome image.

7. The image forming apparatus according to claim 1,
wherein the first measurement image comprises a measurement image with a first number of tone levels, and
wherein the second measurement image comprises a measurement image with a second number of tone levels larger than the first number of tone levels.

8. The image forming apparatus according to claim 1,
wherein the image bearing member comprises an intermediate transfer member onto which the image is transferred, and
wherein the image forming apparatus comprises a transfer device configured to transfer the image from the intermediate transfer member to at least one sheet.

9. The image forming apparatus according to claim 1,
wherein the controller controls the first image forming unit to form the first measurement image, to control the measuring unit to measure the first measurement image, and to generate, based on a result of measurement of the first measurement image and a first coefficient, a first conversion condition for correcting a tone characteristic of a first image to be formed by the first image forming unit,
wherein in a case where a chromatic color image is formed after the predetermined number of monochrome images are formed, the controller controls the first image forming unit and the second image forming unit to form the second measurement image, controls the measuring unit to measure the second measurement image, and generates, based on the result of measurement of the second measurement image and the second coefficient, the first conversion condition and a second conversion condition for correcting a tone characteristic of a second image to be formed by the second image forming unit.

* * * * *